US006145256A

United States Patent [19]

Cittadini et al.

[11] Patent Number: 6,145,256

[45] Date of Patent: Nov. 14, 2000

[54] THERMAL-INSULATION ELEMENT IN PARTICULAR FOR WINDOW AND DOOR FRAMES AND THE LIKE

[75] Inventors: Paolo Cittadini, Luvinate; Alfonso Caldiroli, Legnano, both of Italy

[73] Assignee: Industrie ILPEA S.p.A., Italy

[21] Appl. No.: 09/171,353

[22] PCT Filed: Apr. 30, 1996

[86] PCT No.: PCT/IT96/00086

§ 371 Date: Oct. 16, 1998

§ 102(e) Date: Oct. 16, 1998

[87] PCT Pub. No.: WO97/41326

PCT Pub. Date: Nov. 6, 1997

[51] Int. Cl.[7] ..... E06B 3/988

[52] U.S. Cl. ..... 52/204.7; 52/204.69; 52/214; 52/204.62; 49/478.1

[58] Field of Search ..... 52/204.1, 204.71, 52/204.62, 204.67, 214, 204.69, 204.7; 49/475.1, 478.1

[56] References Cited

U.S. PATENT DOCUMENTS

| | | | |
|---|---|---|---|
| 5,129,184 | 7/1992 | Fish | 49/478 |
| 5,461,831 | 10/1995 | Michal | 52/1 |
| 5,476,318 | 12/1995 | Yingst et al. | 312/405 |
| 5,575,485 | 11/1996 | Merla et al. | 277/80 |
| 5,816,080 | 10/1998 | Jeriorowski | 62/441 |

FOREIGN PATENT DOCUMENTS

| | | |
|---|---|---|
| 0605829 | 7/1994 | European Pat. Off. . |
| 2013245 | 11/1970 | Germany . |
| 2112425 | 9/1972 | Germany . |
| 3101630 | 2/1982 | Germany . |
| 8613038 | 8/1986 | Germany . |

*Primary Examiner*—Carl D. Friedman
*Assistant Examiner*—Yvonne M. Horton
*Attorney, Agent, or Firm*—Robert F. I. Conte Lee, Mann, Smith, McWilliam, Sweeney & Ohlson

[57] ABSTRACT

A thermal-insulation element for window and door frames, which has a main body adapted to be operatively interposed between an inner half and an outer half of the framework of the door or window frame. There is an abutment portion projecting in a transverse direction from the main body and adapted to receive a head portion of a weather strip coming into abutment against it. A magnetic material is operatively associated with the abutment portion and an axial stop is operatively associated with the magnetic material to prevent expansions/contractions of the magnetic means.

18 Claims, 2 Drawing Sheets

THERMAL-INSULATION ELEMENT IN PARTICULAR FOR WINDOW AND DOOR FRAMES AND THE LIKE

DESCRIPTION

Figure 1:
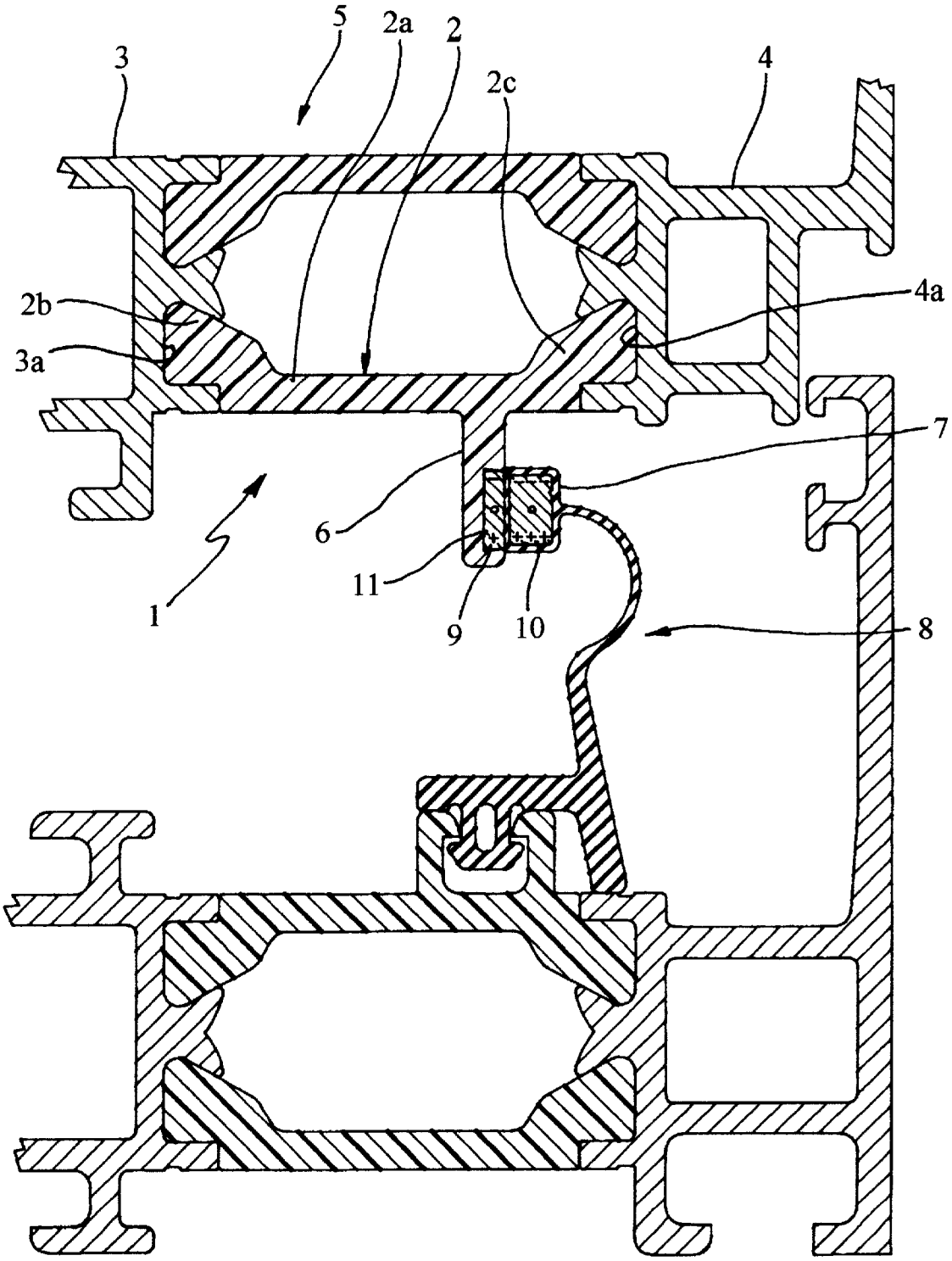

The present invention relates to a thermal-insulation element, in particular for window and door frames and the like.

It is known that in applications such as building window and door frames and at all events—in any other application in which an internal environment is to be insulated from an external one by glass panes, supporting frameworks or glass sashes are used that are provided with thermal-insulation elements.

In more detail, these sashes, be they fixed or movable frameworks, consist of an external half and an internal half between which one or more thermal-insulation elements are operatively interposed which are made of thermally insulating material and arranged to follow the whole perimeter of the supporting framework and engage in corresponding seats formed in said halves.

Practically the thermal-insulation elements of known type usually consist of thermally insulating bars of a substantially rectangular section.

While these thermal-insulation elements are widely used and efficient, they however appear to be susceptible of improvement in particular with reference to applications to window and door frames and the like in which weather strips of the magnetic type are used or strips consisting of a sealing portion incorporating magnetic charges or with which magnetic charges are associated in order to push the sealing portion, during the closing step, towards a counter-pole which is obviously magnetized too.

It is to point out in fact that until now, when this type of weather strip was employed, one was obliged to predominantly resort to the simultaneous use of two of said strips, one of which was in engagement with the fixed framework and the other with the movable framework forming the window or door frames, in order to carry out the desired hermetic seal.

Therefore, while the use of magnetic weather strips ensures a great operating efficiency and reliability over time, as described in the Italian Patent and Utility Model applications no. MI92A00469 and No. 21806B/86 respectively, in the name of the same Applicant, from the point of view of production and installation these strips have highlighted some problems.

In fact, for application of a closing system involving a magnetic weather strip to a building framework, two weather strips need to be associated, as said, which will bring about important installation and operation costs. In addition, common frames for building fixtures are never provided with attachment areas for said strips and do not afford sufficiently wide operating spaces for installation and operation of a pair of magnetic weather strips. In other words, if one wishes to adopt this type of closure, frames suitably planned and sized for receiving this kind of weather strips need to be made.

Therefore, an unresolved technical problem is still represented by the impossibility of conveniently employing magnetic weather strips of the type briefly described above without being obliged to provide relatively wide operating spaces in the sections of the frames with which said weather strips are to be associated, which will bring about, as a result, the impossibility of utilizing supporting frameworks similar to those traditionally available for compression weather strips for example.

Under this situation it is an object of the present invention to solve the above mentioned drawbacks, in particular with reference to door or window frames having a thermal insulation, by providing a thermal-insulation element for window and door frames and the like, as described in the appended claims.

Another object of the invention is to provide a thermal-insulation element which, while being capable of solving the technical problems pointed out above, is in any case of easy and economical manufacture and ready installation, due to its great structural simplicity.

The foregoing and further objects that will become more apparent in the progress of the present description are substantially achieved by a thermal-insulation element, in particular for window and door frames and the like, as defined in the appended claims.

Figure 2:
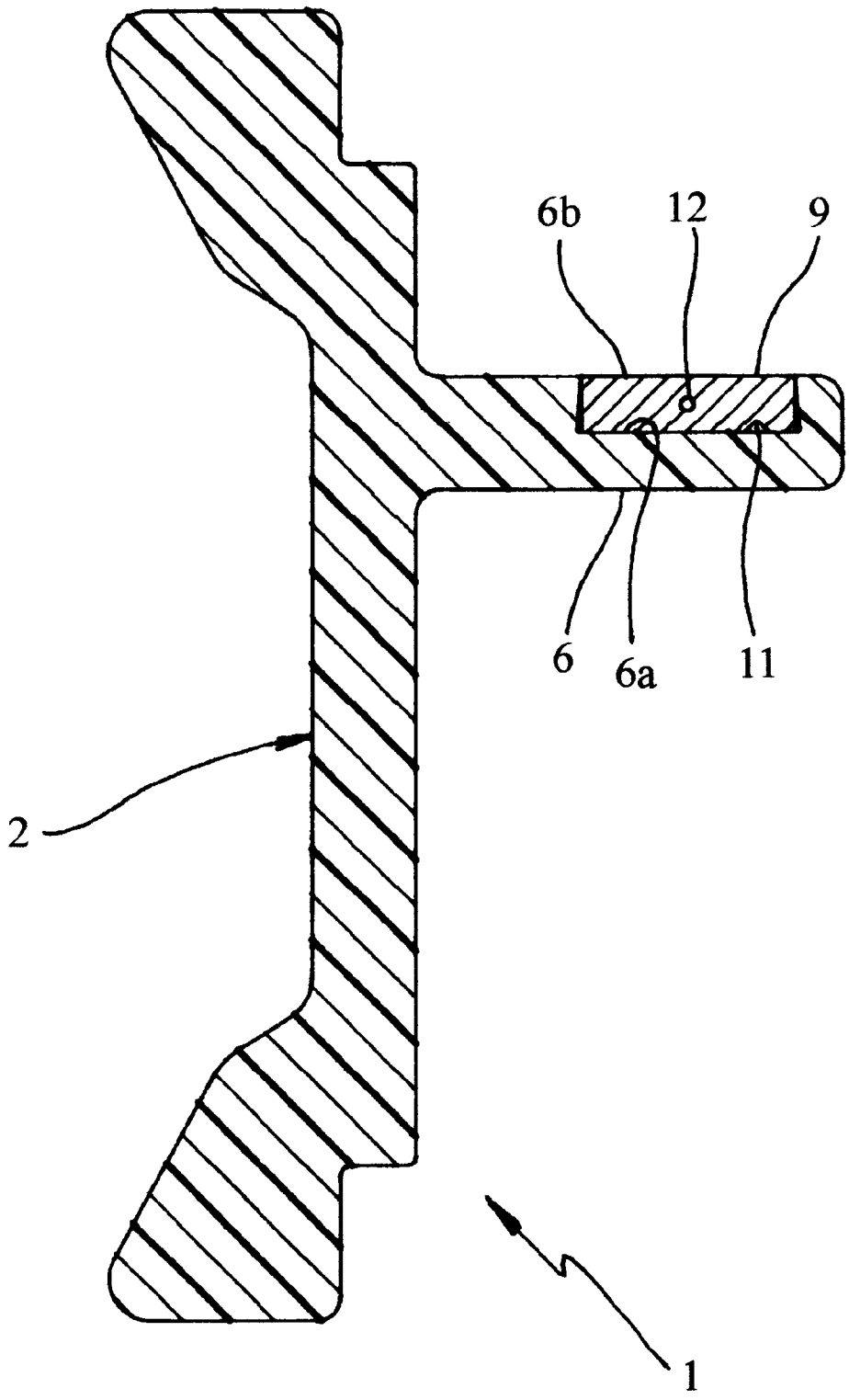

Further features and advantages will be more fully understood from the detailed description of a preferred non-exclusive embodiment of a thermal-insulation element in accordance with the invention which is given hereinafter by way of non-limiting example, with reference to the accompanying drawings, in which:

FIG. 1 is an enlarged cross sectional view of a thermal-insulation element in accordance with the invention in engagement with a respective supporting framework and operatively associated with a weather strip of the magnetic type; and FIG. 2 is a cross sectional view of the thermal-insulation element shown in FIG. 1 on a still more enlarged scale.

With reference to the drawings, a thermal-insulation element in particular for window and door frames and the like in accordance with the present invention has been generally identified by reference numeral 1.

The thermal-insulation element 1, made of a thermally insulating material such as polyamide 66 reinforced with glass fibres for example, comprises a main body 2 designed to be operatively interposed between an inner half 3 and an outer half 4 of a door or window framework 5.

In this case, as shown in FIG. 1, the thermal-insulation element 1 is associated with a fixed framework, but obviously the same element could be associated in exactly the same manner with movable frameworks of the bascule or sliding type for example, and others.

In more detail, the main body 2 is comprised of a central portion 2*a* substantially of planar conformation, and end portions 2*b* and 2*c*, disposed opposite each other and capable of being fitted into longitudinal seats 3*a*, 4*a* formed in said inner half 3 and outer half 4 of the framework 5.

In an original manner, the thermal-insulation element 1 comprises an abutment portion 6 projecting in a transverse direction from said main body and intended for receiving in abutment relationship a head portion 7 of a sealing weather strip generally identified by 8.

Still in accordance with the invention, operatively associated with said abutment portion 6 is magnetic means 9 which is advantageously arranged to interact with corresponding magnetic means 10 associated with said head portion 7 so as to accomplish the desired seal between the weather strip and the abutment portion.

In more detail, the magnetic means 9 substantially and preferentially consists of a band of magnetic material engaged in a longitudinal housing 6*a* formed in the abutment portion 6. The longitudinal housing 6*a* can be defined by a mere groove formed in the abutment portion, as shown in the accompanying figures for example, or a through channel of a square or rectangular section for example, formed in said abutment portion too.

From the point of view of construction, the band of magnetic material 9, to be made either of plastoferrite or a metal material, can be associated with the respective longitudinal housing 6*a* for example by gluing or forced fitting, either directly during the extrusion step for the manufacture of element 1 (in which case the magnetic material can be also incorporated in the abutment portion 6) or during a subsequent step.

Still with reference to the band 9, it is to note that the magnetic charges on the band are to be distributed in such a manner that the opposite poles are located at opposite ends of the band itself with reference to a direction transversely of the main body according to which the abutment portion 6 extends.

In addition, a longitudinal notch denoted by 11 is advantageously provided on the magnetic band 9 (see FIG. 2), for polarity recognition purposes.

Also advantageously provided is axial stop means 12 operatively associated with said magnetic means 9 to prevent the latter from expanding/contracting on the occurrence of sudden changes of temperature even of great importance to which the thermal-insulation element 1 in accordance with the invention may be subjected in operation.

Preferably, the axial stop means 12 comprises at least one elongated element incorporated in the magnetic means 9 and consisting of at least one cord of metal material or synthetic fibre, fibre glass for example, disposed at a central axis of symmetry of the magnetic means 9.

Finally, according to a preferential solution of the abutment portion 6, said portion may comprise a longitudinal lip disposed perpendicularly to the main body 2 and defining a substantially flat active surface 6*b* for receiving the head portion 7 of the weather strip 8 coming into abutment against it in an efficient manner when the window or door frame is in a closed position, so that an appropriate seal is ensured.

By virtue of the particular distribution of the magnetic charges on the band 9 and the flat conformation of the abutment portion 6, a very efficient seal is achieved under operating conditions because the head portion 7 of the weather strip 8, if said portion too is provided with a magnetic band having the same charges distributed with opposite signs with respect to the band 9 (see in this connection FIG. 1), will automatically tend to seek for an appropriate abutment position against the abutment portion 6, thereby avoiding jammings and malfunctions even in the presence of imprecise assemblings, errors or wide working tolerances.

The invention achieves important advantages.

It is to note in fact that while the thermal-insulation element in question maintains a very simple structure enabling a cheap accomplishment and easy installation of same, it is capable of substantially solving all drawbacks typical of the traditional embodiments.

In particular, the thermal-insulation element in accordance with the invention enables application of magnetic weather strips to frameworks of the traditional type as well, without on the other hand occupying more space than that required for the installation of conventional compression weather strips.

It will be also recognized that the thermal-insulation element described above can easily operate in association with compression weather strips, advantageously offering an abutment portion for said strips, without requiring particular modifications. In other words, due to its original conformation, the thermal-insulation element in accordance with the invention can be easily employed with any type of weather strip, which will make it very advantageous from the point of view of management.

The invention is advantageous in its most specific aspects.

In fact, due to the particular solid conformation of the abutment portion and the particular distribution of magnetic charges therein, an efficient coupling with the head portion of a magnetic weather strip is ensured and, as a result, an efficient seal under operating conditions.

In addition, due to the presence of the cord embodying the axial stop means 12, the band of magnetic material is very stable from a structural point of view, that is substantially devoid of axial deformations even in the presence of important thermal gradients.

Finally it is pointed out that the structural simplicity of the weather strip in spite of the presence of the magnetic means, ensures an easy setting up without giving rise to particular problems in carrying out junctions at the corner areas of the frameworks with which the thermal-insulation elements are associated.

Obviously, many modifications and variations may be made to the invention as conceived, all of them falling within the scope of the inventive idea characterizing it.

What is claimed is:

1. A thermal-insulation element for window and door frames, comprising:

a main body (2) adapted to be operatively interposed between an inner half (3) and an outer half (4) of a framework (5) of a door or window frame;

an abutment portion (6) projecting in a transverse direction from said main body and adapted to receive a head portion (7) of a weather strip (8) coming into abutment against it; magnetic means (9) operatively associated with said abutment portion; and axial stop means (12) operatively associated with said magnetic means (9) to prevent expansions/contractions of said magnetic means.

2. A thermal-insulation element according to claim 1, wherein said abutment portion (6) comprises a longitudinal lip located perpendicularly to said main body.

3. A thermal-insulation element according to claim 2, wherein said longitudinal lip defines a substantially flat active surface (6*b*) for receiving said head portion (7) of the weather strip (8) in abutment relationship therewith.

4. A thermal-insulation element according to claim 1, wherein said magnetic means (9) consists of a band of magnetic material engaged in a longitudinal housing (6*a*) formed in said abutment portion (6).

5. A thermal-insulation element according to claim 4, wherein said longitudinal housing (6*a*) is defined by a groove formed in the abutment portion (6).

6. A thermal-insulation element according to claim 4, wherein said longitudinal housing (6*a*) is defined by a through channel formed in said abutment portion (6).

7. A thermal-insulation element according to claim 4, wherein said band of magnetic material is made of plastoferrite.

8. A thermal-insulation element according to claim 4, wherein said band of magnetic material is made of a metal material.

9. A thermal-insulation element according to claim 4, wherein said band of magnetic material is associated with the respective longitudinal housing (6*a*) by gluing.

10. A thermal-insulation element according to claim 4, wherein said band of magnetic material is associated with the respective longitudinal housing (6*a*) by forced fitting.

11. A thermal-insulation element according to claim 4, wherein said band of magnetic material is associated with the respective longitudinal housing (6*a*) by a co-extrusion process.

12. A thermal-insulation element according to claim 4, wherein said band of magnetic material is wholly incorporated in said abutment portion (6).

13. A thermal-insulation element according to claim 4, wherein the magnetic charges of said band are distributed in such a manner that the opposite poles are located at opposite ends of the band itself with reference to said direction transversely of the main body (2).

14. A thermal-insulation element according to claim 4, wherein said band of magnetic material comprises at least one longitudinal notch (11) for polarity recognition.

15. A thermal-insulation element according to claim 11, wherein said axial stop means (12) comprises at least one elongated element incorporated in said magnetic means (9).

16. A thermal-insulation element according to claim 15, wherein said elongated element comprises at least one cord of a metal material or a synthetic fibre disposed at a central axis of symmetry of said magnetic means.

17. A thermal-insulation element according to claim 1, wherein said main body (2) comprises a substantially planar central portion (2*a*) and opposite end portions (2*b*, 2*c*) intended for fitting into longitudinal seats (3*a*, 4*a*) formed in the inner half (3) and the outer half (4) of said framework (5).

18. A thermal insulating element for window and door frames comprising:

a rigid body (2) adapted to be operatively engaged between an inner half (3) and an outer half (4) of a framework (5) of a door or window frame, said main body presenting a substantially planar central portion, a first end portion (2*b*) adapted to fit into a longitudinal seat (3*a*) formed in the inner half (3) of the framework (5), and a second end portion (2*c*) opposite to the first end portion and adapted to fit into a longitudinal seat (4*a*) formed in the outer half (4) of the same framework (5);

a rigid abutment portion (6) projecting in a transverse direction from said main body and defining an abutment for a head portion (7) of a weather strip; and magnetic means (9) operatively associated with said abutment portion.

* * * * *